United States Patent [19]

Van Ocker et al.

[11] Patent Number: 4,493,572

[45] Date of Patent: Jan. 15, 1985

[54] LONG-LIFE INKED-RIBBON CASSETTE

[75] Inventors: William G. Van Ocker, Philadelphia; Ivan Pawlenko, Levittown; Donald F. Reider, Philadelphia; Charles J. Troebs, Philadelphia; Robert A. Clair, Philadelphia; Stanley C. Crandall, Holland, all of Pa.

[73] Assignee: Avery International Corp., Pasadena, Calif.

[21] Appl. No.: 446,249

[22] Filed: Dec. 2, 1982

[51] Int. Cl.[3] ..... B41J 32/02; B41J 31/16

[52] U.S. Cl. ..... 400/196.1; 400/224; 400/208; 400/202; 400/195

[58] Field of Search ..... 400/196.1, 196, 195, 400/224, 208, 202, 202.1, 202.2, 202.4, 197

[56] References Cited

U.S. PATENT DOCUMENTS

| | | | |
|---|---|---|---|
| 4,091,913 | 5/1978 | Ku et al. | 400/124 |
| 4,153,378 | 5/1979 | Scherrer et al. | 400/196.1 |
| 4,209,261 | 6/1980 | Bell et al. | 400/196.1 |
| 4,210,403 | 7/1980 | Mazouet et al. | 400/196.1 |
| 4,212,420 | 7/1980 | Helinski | 400/196.1 |
| 4,273,453 | 6/1981 | Haftmann | 400/202.4 |
| 4,279,522 | 7/1980 | Yonkers | 400/195 |
| 4,300,847 | 11/1981 | Hoffman et al. | 400/196.1 |
| 4,325,645 | 4/1982 | Miyajima et al. | 400/196.1 |
| 4,351,619 | 9/1982 | Duke et al. | 400/196.1 |

FOREIGN PATENT DOCUMENTS

| | | | |
|---|---|---|---|
| 0142688 | 7/1980 | Japan | 400/202 |

*Primary Examiner*—Edgar S. Burr
*Assistant Examiner*—M. J. Hirabayashi
*Attorney, Agent, or Firm*—Christie, Parker & Hale

[57] ABSTRACT

A long-life inking cassette is provided wherein an inkable ribbon is pumped into a ribbon storage zone by a pair of textured nip rollers. The ribbon is drawn from storage, rotated 180°, re-inked, and passed at an angle and under tension past a print head before being returned to the nip rollers. A pair of dams are positioned to contact opposed edges of the ribbon as the ribbon leaves the storage zone to prevent folds of the ink ribbon from passing outwardly from the storage zone. Means are provided to amplify the drag on the ribbon between a dispensing pin at the outlet of the storage zone and an end of a first leg of the cassette. The drag amplification causes the ribbon to be taut when drawn past the printhead.

11 Claims, 7 Drawing Figures

LONG-LIFE INKED-RIBBON CASSETTE

BACKGROUND OF THE INVENTION

Printers with associated cassettes to provide inked ribbons for their print heads are old in the art. Many suffer deficiencies. It has been our concern to devise a cassette with a protracted lifetime, giving over an 8-million-character service, and yet offering an overall net simplicity in cassette design which can be manufactured at a low cost. This is the subject of the instant invention.

SUMMARY OF THE INVENTION

According to the present invention, there is provided a long-life inking cassette which is adapted for use in a generally vertical position. The cassette basically provides a housing having a lower open portion adapted to receive and provide clearance for the print head. The left-hand section of the cassette body consists of at least one pair of nip rollers, each providing a textured elastomeric surface, which cooperate with an engaged, inked ribbon to maintain draw of the inked ribbon across the surface of one of the rollers until a releasing surface is contacted. The releasing surface cooperates within the chamber in which the inked ribbon is contained to transfer the ribbon to the opposed roller, where the action is repeated. In essence, the rollers cooperate with the inked ribbon to accumulate in a vertically-oriented ribbon storage chamber, a large mass of "Z" fan-folded, inked ribbon, ready for service. When drawn, however, from the reservoir in which the ribbon pack is compact, this cooperates with the balance of the cassette system, which provides sufficient friction to enable the ribbon to be drawn in taut relation over the imprinter and returned to the nip rollers which, in substance, control the operation of the system.

To optimize operation, the preferred construction employs a 180° turn of the ribbon during its transit through the cassette, in combination with re-inking of the surface of the ribbon, and passage of the ribbon at an angle relative to the angle of traverse of the imprinter, to vary that portion of the ribbon which is impacted by the imprinter to extend its life. A functional cover protects the whole assembly.

More particularly, the long-life inking cassette adapted for use in a vertical orientation comprises an upper chamber, a wall-divided, inked-ribbon storage section and an inking section. A pair of textured-surface nip rollers are centrally located at the inlet to the inked-ribbon storage section. An inked transfer surface is located in an inking section comprising an ink-pickup transfer roller which is coated with ink supplied from a reservoir. As previously indicated, the nip rollers operate to build a storage of inked ribbon within the inked-ribbon storage section and, by continuous operation, draw ribbon from the top of the chamber, where it is rotated 180°, and passed over the inking roller and downwards of a first leg of the cassette having a passageway which turns and draws the ribbon sideways and backwards so that it will leave, buckle-free, at the base of the cassette, at a more rearward position than the opposed end of the base of the cassette. This enables the ribbon to move across the area of traverse of the imprinter at an angle thereto and, again, to maximize lifetime of the ribbon.

In operation, the focal point of the system is the nip rollers. The nip rollers act to draw, in taut relationship, the inked ribbon across the area in which the imprinter operates, and pump the ribbon into "Z" fan-folding segments which accumulate in the ribbon reservoir. By continuous operation of the nip rollers, the ribbon is drawn over a pin, rotated 180° by use of dams, passed over a pair of additional pins, re-inked and drawn down a downward passage, in taut relationship, exiting the base of the passage in a taut condition, for angular movement across the opening available for the print head. Once past the print head, it returns to the opposite leg of the cassette and to the nip rollers, where the sequence of ribbon-folding is repeated.

The bulk of some 90 feet of ribbon used in the cassette printer is contained in the inked-ribbon storage section. The balance moves across the tortuous path from the top of the inked-ribbon storage section through the nip rollers, to insure continuous, trouble-free operation for the imprinting of characters in excess of eight million, before wear-out or ink depletion occurs.

THE DRAWINGS

FIG. 1 details the continuous, inked-ribbon cassette, showing the path of travel of the ribbon and its various manipulations during travel, and the opening to accommodate the print head.

DETAILED DESCRIPTION

Figure 1:
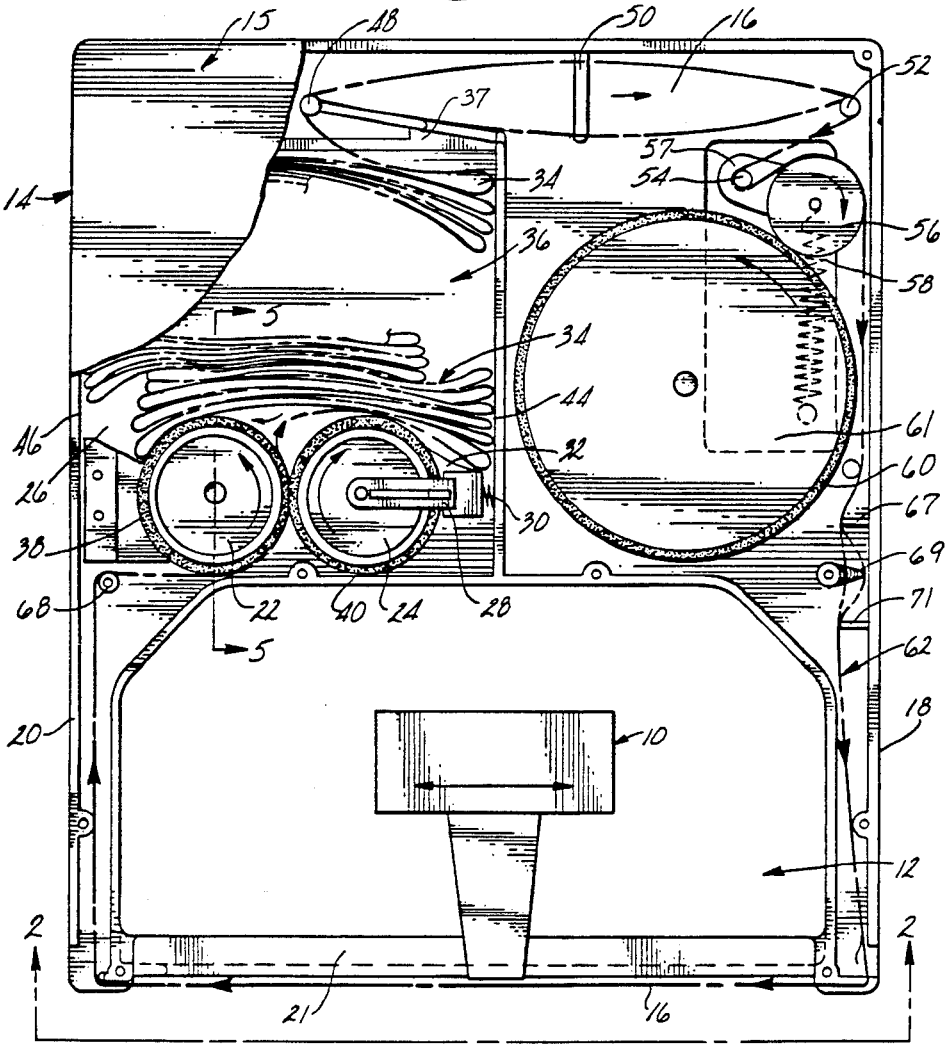
Figure 2:
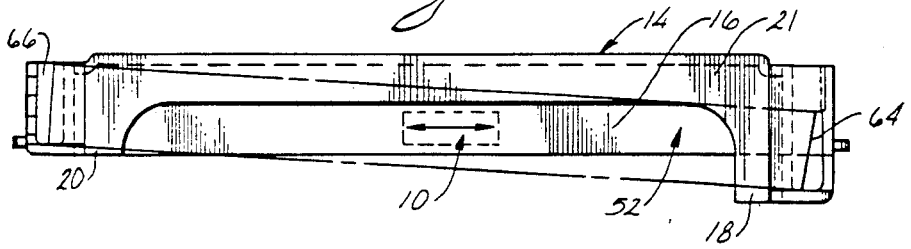
FIG. 2 is a bottom-end view of FIG. 1, taken at 2—2, to show the angled traverse path of the ribbon across the opening available for the print head.
Figure 3:
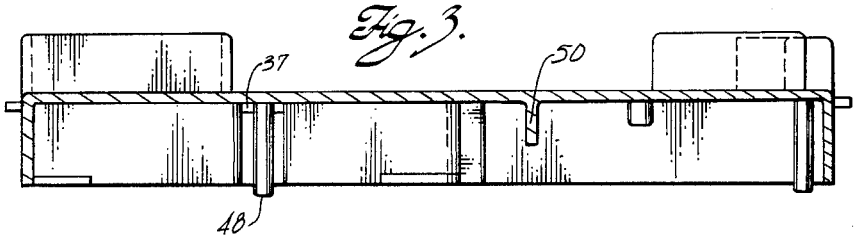
FIG. 3 is a top-end view taken, with reference to FIG. 4, at 3—3, showing some of the functional elements which control ribbon travel.
Figure 4:
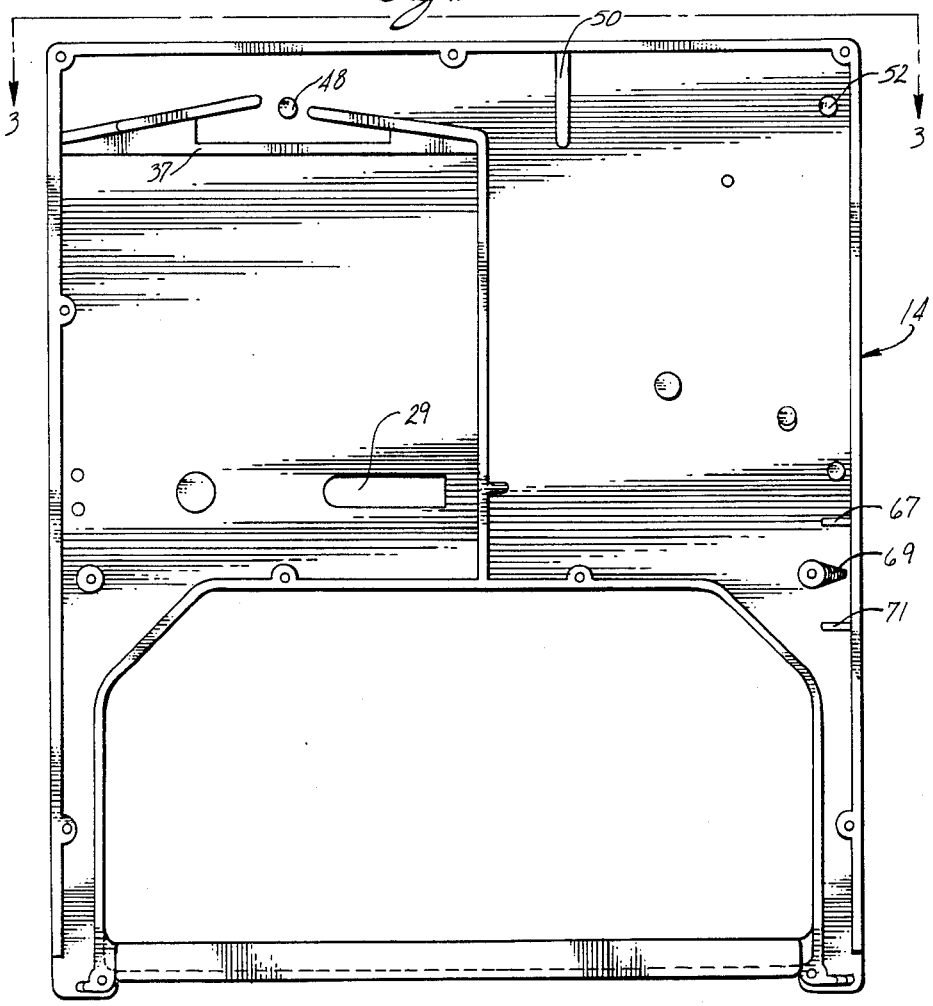
FIG. 4 is a face view of the cassette body, showing elements of construction which control operation.

With reference to FIGS. 1-7, there is provided in accordance with the present invention a novel, long-life inking cassette for positioning in vertical orientation, for use in combination with a fixed, but preferably horizontally-movable, printer.

The long-life print head 10 moves across the available opening 12 provided by the body of cassette 14. The print head 10 operates on a taut section of an exposed, inked ribbon 16 passing, with reference to FIG. 2, in taut relation to print head 10 between legs 18 and 20. The cantilever load produced by taut ribbon 16 between legs 18 and 20 is absorbed or supported by cross-member 21. Movement of the ribbon 16 at about 38 inches per minute past print head 10, is provided by the tractor action of nip rollers 22 and 24 operating against frictional resistance on the ribbon from the cassette. In the configuration shown, nip roller 22 is a fixed, driven roller and cooperates with "stripper" or release-surface 26, which is fixed to the cassette, whose function will be hereinafter described. Nip roller 24 is contained on frame 28 and biased by spring 30 against nip roller 22. Part of frame 28 is "stripper" or release-surface 32, the function of which will be hereinafter detailed. Frame 28 slides in slot 29 in the body of cassette 14 and in slot 29 of cover 15.

Figure 5:
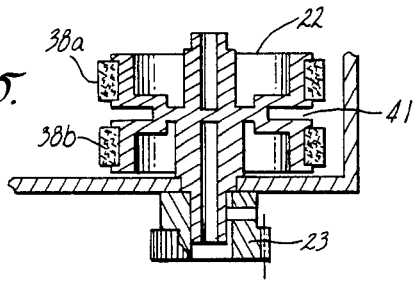
FIG. 5 is a side view of the driven nip roller, showing the presently preferred tire configuration.

In operation, the ribbon is pumped upwards through the nip rollers 22 and 24 by their shown counter-rotation, and is "Z" fan-folded into a ribbon pack 34 contained in reservoir or chamber 36. Rollers 22 and 24 have on their outside surfaces, textured tires 38 and 40, which are elastomeric in nature. A suitable material for the tires is Scottfelt ®, a commercially-available, compressed, semi-rigid, open-cell, polyurethane foam having a firmness of 16, manufactured and sold by Scott Paper Company. Preferably, as shown in FIG. 5, two tires **38*a* and 38*b* are employed in roller 22, with groove 41 being provided to accept stripper 26. A corresponding configuration is employed for undriven nip roller 24. Roller 22 also carries drive gear 23**.

The stripper blades act in cooperation with the textured surface of the tires to prevent the ribbon from continuing to tack-stick to the surface of the tires after passing through the nip. In sum, they cause release of the ribbon from the tire surface. This averts a tangled jam between the ribbons and tires, and is essential to fan-folding of the ribbon. It is presently preferred that the porous, polyurethane tires be preloaded with ribbon ink so that, instead of acting as absorbers of ink delivered by the ribbon, they can actually act to contribute ink to ribbon 16, or at least to sustain ink level.

The requirements of tires 38 and 40 are that in cooperation with the inked ribbon passing therebetween, they provide sufficient friction to maintain the ribbon taut as it is drawn past print head 10, and yet insufficient friction to cooperate with stripper blades 26 and 32 to enable fan-folding within inked-ribbon storage chamber 36. As depicted in FIG. 1, fan-folding occurs in the following way. The ribbon may be initially picked up by biased nip roller 24 and caused by the stripper blade 32 to be lifted away from the surface of the tires. As the ribbon advances to the wall 44, it begins to move, as shown, in the direction of driven roller 22. Striking the wall forces the ribbon to be engaged by tire(s) 38 and carried across to stripper blade 26 where, again, in cooperation with wall 46, a new fold is started. This operation continues to accumulate fan-folded ribbon in inked-ribbon storage chamber 36 to maintain a small force, or head, of approximately 40 grams against the top of the rollers and on the portion of ribbon emerging from the nip between rollers 22 and 24.

In the presently preferred design, inked-ribbon storage chamber 36 measures some 4 inches by 4 inches, and some 90 feet of ribbon are fan-folded therein. To enable use of both sides of the ribbon, the ribbon is continuous and is welded at a 180° turn.

Nip rollers 22 and 24, which cooperate to pump ribbon into inked-ribbon storage chamber 36, also act to draw ribbon over pin 48. The ribbon, before passing over pin 48, is caused to pass between curbs 37 and 39, which serve to separate plies of ribbon that may be tacked together by the ink. This is important, for if an extra fold were released from inked-ribbon storage chamber 36, it could cause the ribbon to go slack, disabling the cassette. Following passage over pin 48, the ribbon is passed over wall 33 in cassette cover 15, wall 50 in cassette base 14, and wall 35 in cassette cover 15. This action maintains the 180° turn in the ribbon. The ribbon is then passed over smooth-surfaced ink-transfer roller 56, which is drawn in tension by spring 58 against ink reservoir 60. Ink reservoir 60 contains the ink typically used in the system, is formed of a porous Scottfelt disk contained between metal side plates 61, and is rotated by the passage of ribbon over ink-transfer roller 56 on lever 57 to constantly replenish the ribbon with new ink. The ribbon, after being inked, is passed through a guidepath 62, where it passes over bar 67, over slanted guide 69, then over bar 71. The effect urges the ribbon back and to an angle, with respect to normal travel. The angle of slanted guide 69 takes out the buckle which would otherwise occur when the ribbon is deflected to the rear of the cassette. It exits arm 18 at an angle of about 9°, 38′, at opening 64, and travels past the print head and returns at opening 66, which has an angle of about 3°, 13′, the plane of the cassette. From there it passes over fixed guide 68 back to the cooperating nip rollers 22 and 24.

In the presently preferred construction, the ribbon utilized is a 4-mil-thick, woven, nylon, medium-inking ribbon using Allied 195 black ink, supplied by Allied Carbon & Ribbon Mfg. Corp., 67 Kent Avenue, Brooklyn, N.Y. 11211. It is constructed with a 180° twist so that the ribbon will continuously be turned over in each passage from inked-ribbon storage chamber 36 to nip rollers 22 and 24.

Movement of the ribbon in a direction angular of print head 10 continuously varies that portion of the ribbon which is exposed to the print head, aiding in providing the cassette with a lifetime in excess of 8-million characters. In operation, the ribbon, after being pumped into chamber 36, dwells there essentially inactive for approximately ½ hour. At the end of this residence time, it is gently lifted off the top of the pack to begin a circuit back to the pack. Here again, the reliable and continuous density of the ribbon pack and the "Z" fan-folds combine respectively to maintain a constant head space above ribbon pack 34 while ribbon pack 34, in turn, maintains a head on the nip rollers and produces a low and only slightly varying frictional drag on the ribbon over the dispensing pin 48. This requirement of low drag is critical, since the drag over the pin is multiplied many times over by frictional amplification due to other rubbing surfaces along the ribbon's circuit through the cassette. Frictional amplification is insufficient to induce slippage of the ribbon between the nip rollers, for if it were to occur, the ribbon would stall.

Reservoir 60, as indicated, is an essentially sponge-like structure of the same material used for the tires, and is loaded by absorption with about 50 grams of ink. Rotation of reservoir 60 in combination with roller 56 causes ink to be deposited on the surface of transfer roller 56 from reservoir 60 and from there, to the surface of ribbon 16, thus re-inking the ribbon.

Roller 56, as indicated, is preferably smooth-surfaced and is formed of a non-porous plastic urethane resin, making it an ideal ink-transfer medium. Spring 58 produces a constant force of about ½ pound between ink-transfer roller 56 and ink reservoir 60. This force causes ink to be squeezed out of reservoir 60 onto roller 58 at a metered rate, so that the ink available for character printing is depleted gradually over the 8-million-character service life. The ink normally added to the ribbon 16 has a viscosity of about 1100 centipoise, and the ink in the reservoir 60 has a viscosity of about 28±7 centipoise.

As indicated, the ribbon passes from roller 56 downward to the right leg of the cassette. The leg is angled backwards. This causes the ribbon in the taut section of the channel to pass under the print head 10 reciprocating path at a slight angle. The purpose of this angular passage is to reduce wear on the ribbon by spreading that wear across the full width of the ribbon. Tracking of the ribbon down the backward-angle right leg of the cassette is facilitated by ribbon-steering blades 67 and 71, molded into the cassette base at 62. Tension in the taut section of the ribbon is provided by the tractor action of the nip rollers acting against the drag on the ribbon during its passage through the cassette. Drag is attenuated by the lubricity of the preferably employed Celcon®, an acetal resin manufactured and sold by Celanese Chemical Co.

The preferred ink used in reservoir 60 is, as compared to the viscosity of the inked ribbon 16, of lower viscosity. As such, it wicks into the porous reservoir roller, and the rolling of reservoir 60 facilitates transfer of ink to the ribbon, during the re-inking operation, indirectly through ink-transfer roller 56. In the presently preferred construction, the high viscosity of the ribbon ink as supplied acts as a primer, base, and/or wetting agent for the lower-viscosity ink from the reservoir roller, and the combining of these two inks over the cassette's operating life has been observed to be a factor in the extreme length of operating life.

Figure 6:
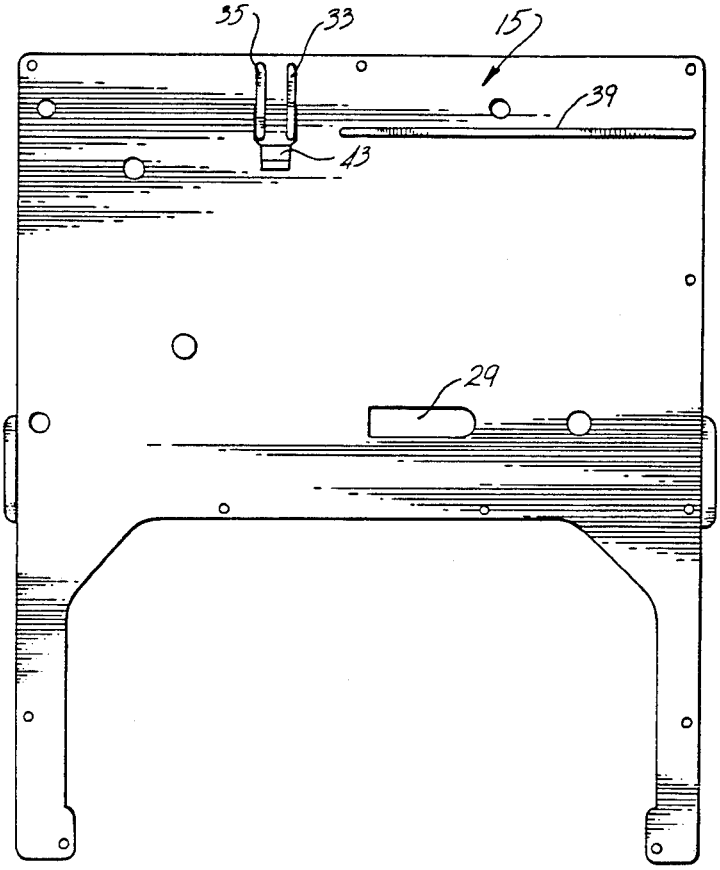
FIG. 6 is an underview of the cassette cover, showing elements contributing to operation.
Figure 7:
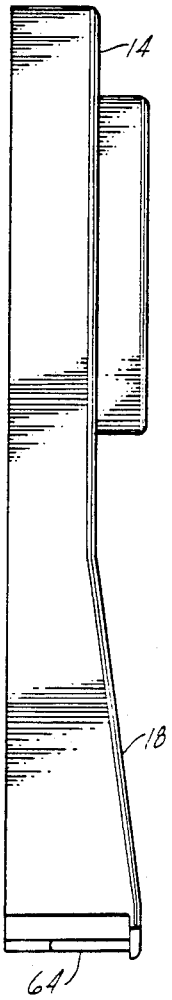
FIG. 7 is an outline of an end view of FIG. 1 to show the leg in which the ribbon is moved rearward to the base of the cassette.

A tab 43, as shown in FIG. 6, or its equivalent is provided to prevent lateral ribbon movement.

What is claimed is:

1. An inking cassette for use in a vertical position with an imprinter printing head having a line of travel, said inking cassette comprising:

a housing including a storage chamber for fan-folded, inked ribbon and an adjacent inking means adapted to be positioned above the printing head, said storage chamber having a lower and an upper end with an inlet being located at the lower end and an outlet being located at the upper end, a first leg extending downward from said inking means, and a second leg extending downward from said storage chamber, said first and second legs being arranged to be disposed on opposed sides of the printing head;

a continuous length of inked ribbon disposed in the housing and passing from said first leg to said second leg for movement in a horizontal direction beneath the printing head;

a pair of cooperating nip rollers at the lower end of the storage chamber, said nip rollers having parallel, horizontally disposed axes when said cassette is in the vertical use position, each nip roller providing a textured elastomeric surface and engaging the ribbon therebetween, the rollers adapted to circulate the ribbon along a path from the first leg past the printing head to the second leg, upwards through the nip rollers, fan-folding said ribbon in said storage chamber and causing said ribbon to be removed from the storage chamber, inked by said inking means and back to said first leg, the storage chamber disposed vertically above the nip rollers when the cassette is vertically oriented for use with the printing head, the storage chamber containing a length of said ribbon in a fan-folded ribbon pack extending from the nip rollers to a position above the nip rollers and below the upper end of the storage chamber, to provide a head of ribbon weighing atop the nip rollers, and a dispensing pin providing a drag at an outlet at the upper end of said storage chamber;

a pair of dams positioned to contact opposed edges of the ribbon as the ribbon leaves the storage chamber, to prevent folds of the inked ribbon from passing together outwardly from said storage chamber over said dispensing pin; and means to functionally amplify the drag on the ribbon between the dispensing pin and an end of the first leg to cause said ribbon to be taut when drawn by said nip rollers from said first leg to said second leg.

2. An inking cassette as claimed in claim 1 in which the inking means include a rotatable ink reservoir biased against an ink-transfer roller and in which said inked ribbon is inked by being drawn over said ink-transfer roller.

3. An inking cassette as claimed in claim 2 in which the inked ribbon is preloaded with an ink having a viscosity greater than the viscosity of the contained ink the rotatable ink reservoir.

4. An inking cassette as claimed in claim 1 in which the inked ribbon travels at an angle to the line of travel of the printing head, and said inking cassette includes in said first leg, drag-amplifying means which cooperate to provide buckle-free travel of said taut ribbon from said first leg to said second leg.

5. An inking cassette as claimed in claim 1 which includes means to rotate said inked ribbon 180° between said dispensing pin and said inking means.

6. An inking cassette as claimed in claim 5 in which the inking means include a rotatable ink reservoir biased against an ink-transfer roller and in which said inked ribbon is inked by being drawn over said ink-transfer roller.

7. An inking cassette for use in a vertical position with an imprinter printing head having a line of travel, said inking cassette comprising:

a housing including a storage chamber for fan-folded, inked ribbon and an adjacent inking means adapted to be positioned above the printing head, said storage chamber having a lower and an upper end with an inlet being being located at the lower end and an outlet being located at the upper end, a first leg extending downward from said inking means, and a second leg extending downward from said storage chamber, said first and second legs being arranged to be disposed on opposed sides of the printing head;

a continuous length of inked ribbon disposed in the housing and passing from said first leg to said second second leg for movement in a horizontal direction beneath the printing head;

a pair of cooperating nip rollers at the lower end of the storage chamber, said nip rollers having parallel, horizontally disposed axes when said cassette is in the vertical use position, each nip roller providing a textured elastomeric surface and engaging the ribbon therebetween, the rollers adapted to circulate the ribbon along a path from the first leg past the printing head to the second leg, upwards through the nip rollers, fan-folding said ribbon in said storage chamber and causing said ribbon to be removed from the storage chamber, into contact with said inking means and back to said first leg, the storage chamber being disposed above the nip rollers when the cassette is vertically oriented for use with the printing head and containing a length of said ribbon in a fan-folded ribbon pack extending from the nip rollers to a position above the nip rollers and below the upper end of the storage chamber, to provide a head of ribbon weighing atop the nip rollers and a dispensing pin providing drag at an outlet at the upper end of said storage chamber;

a pair of dams positioned to contact opposed edges of the ribbon as the ribbon leaves the storage chamber, to prevent folds of the inked ribbon from passing together outwardly from said storage chamber over said dispensing pin;

means to rotate said ribbon 180° between said dispensing pin and said inking means; and means to functionally amplify the drag on the ribbon between the dispensing pin and an end of the first leg to cause said ribbon to be taut when drawn by said nip rollers from said first leg to said second leg.

8. An inking cassette as claimed in claim 7 in which the inking means comprises a rotatable ink reservoir and an ink-transfer roller biased against said rotatable ink reservoir, said inked ribbon passing over said ink-transfer roller.

9. An inking cassette as claimed in claim 8 in which the inked ribbon is preloaded with an ink having a greater viscosity than the viscosity of the ink contained in the ink reservoir.

10. An inking cassette as claimed in claim 8 in which means to rotate said inked ribbon 180° comprises a pair of dams positioned between the dispensing pin and the inking means, said dams forming part of the means to functionally amplify the drag on the inked ribbon between the dispensing pin and the end of the first leg and to rotate said inked ribbon 180° between the dispensing pin and said inking means.

11. An inking cassette as claimed in claim 10 in which the inked ribbon travels at an angle to the line of travel of the printing head, and said inking cassette includes in said first leg, drag-amplifying means which cooperate to provide buckle-free travel of said taut ribbon from said first leg to said second leg.

* * * * *